US005507695A

United States Patent [19]

Sajakorpi

[11] Patent Number: 5,507,695

[45] Date of Patent: Apr. 16, 1996

[54] SURFACE ELEMENT FOR FORMATION OF A GLIDING SURFACE

[75] Inventor: Kimmo Sajakorpi, Tampere, Finland

[73] Assignee: Sajakorpi Oy, Tampere, Finland

[21] Appl. No.: 302,833

[22] PCT Filed: Mar. 16, 1993

[86] PCT No.: PCT/FI93/00095

§ 371 Date: Sep. 16, 1994

§ 102(e) Date: Sep. 16, 1994

[87] PCT Pub. No.: WO93/18827

PCT Pub. Date: Sep. 30, 1993

[30] Foreign Application Priority Data

Mar. 17, 1992 [FI] Finland ..... 921127
Sep. 10, 1992 [FI] Finland ..... U920546

[51] Int. Cl.[6] ..... A63C 19/10; A63J 21/00

[52] U.S. Cl. ..... 472/90; 472/88

[58] Field of Search ..... 472/88, 90, 136, 472/137; 404/31, 32, 34, 35, 41, 42; 428/88, 89

[56] References Cited

U.S. PATENT DOCUMENTS 3,407,713 10/1968 Heckman ..... 472/90
3,547,749 1/1969 White et al. ..... 404/32 X

*Primary Examiner*—Kien T. Nguyen
*Attorney, Agent, or Firm*—Pollock, Vande Sande & Priddy

[57] ABSTRACT

A surface element used for forming a gliding surface includes a frame unit provided with at least one attachment element and a joining point, attachment element connecting the frame to a base, a gliding unit formed of a plurality of flexible gliding elements connected to the joining point of the frame unit, and a support unit forming a supporting surface and connected to the frame unit, wherein when a plurality of successive surface elements are arranged in the longitudinal direction to form the gliding surface, the supporting unit of the next surface element supports the gliding unit of at least one preceding surface element.

11 Claims, 3 Drawing Sheets

SURFACE ELEMENT FOR FORMATION OF A GLIDING SURFACE

FIELD OF THE INVENTION

The present invention relates to a surface element for formation of a gliding surface, comprising a substantially transverse frame unit with attaching means for attaching the surface element to the base, a gliding unit with several substantially transverse and flexible gliding means attached to the joining point of the frame unit, such as fibres, strings, threads or the like, and a supporting unit with a supporting surface which is connected with the frame unit and supports the gliding unit of at least one surface element substantially in the longitudinal direction.

BACKGROUND OF THE INVENTION

Gliding elements forming a gliding surface have been used for a long time, usually in down-slopes of ski jumping hills and at the sides of in-run ski tracks uphill. Gliding elements of relatively small size have been arranged side by side and one after another in a way that the abutments of the gliding elements are overlapped to achieve an integrated gliding surface formed by the gliding elements. The gliding properties of the gliding surface correspond very well to the properties of snow, which is important for ski jumping similar to winter conditions also in the summer.

The gliding elements are attached to a framework, such as a metal net, mounted in the slope and thus placed directly below the gliding surface. Consequently, the risk is that if the ski-jumper falls the fibres forming the gliding unit turn away and the ski-jumper hurt himself when falling onto the exposed metal net.

To eliminate this problem, an improved gliding unit is presented in the Patent Publication FI-71065.

The solution presented in the publication is characterized in that a bottom plate, either uniform or formed of separate strips, corresponding substantially to the size of the gliding element is attached to the same abutment below a plastic mat. As an advantageous embodiment, also a profile bottom plate is presented in the publication. With the profile form, it was attempted to make the gliding element flexible in order to avoid the need for using an additional flexible layer, usually of cellular plastic, commonly used underneath the metal net. In spite of its advantageous principle, this solution has obviously not convinced the users, because its application in practice has remained insignificant.

Particularly when equipped with a uniform bottom plate, the embodiment described above might, in principle, function in a reasonable way. Nevertheless, this embodiment still has the disadvantage typical of conventional gliding elements that the length of the gliding unit of the gliding element substantially corresponds to the total length of the gliding element. However, relatively long fibres do not function satisfactorily, because in practice they are placed and returned into the longitudinal direction at random. Consequently, after the previous jump, the coating may have openings with uncovered metal net or bottom plate.

The problem described above can be overcome by placing several gliding elements on top of each other in a way that there are several layers of gliding units. In the embodiment presented in the Finnish Patent Publication mentioned above, it is possible to make the total length of the gliding element correspondingly shorter. However, such arrangements are not economically advantageous, because the covering must thus be formed of a relatively large number of gliding elements.

Further, the profile bottom plate used in the embodiment of the above patent publication is not particularly advantageous, because it has a corrugated form in the transverse direction which produces a "nubbly" coating and thus may hamper the return of the fibres into the longitudinal direction.

SUMMARY OF THE INVENTION

It is a purpose of the present invention to eliminate the disadvantages presented above and thus to improve the state of knowledge in the field. For achieving this in, the surface element of the invention the supporting unit of the surface element is arranged in connection with the frame unit in such a way that in the gliding surface formed of several successive surface elements in the longitudinal direction, the supporting unit of the next surface element forms the supporting surface supporting the gliding unit of at least one preceding surface element.

The most important advantages of the surface element of the invention are its simplicity and reliability, which are essential prerequisites for improving safety, particularly in the demanding field of the invention. The surface element of the invention is inexpensive to manufacture and install, whereby also the total costs of the coating made thereof are clearly less in comparison with the present solutions. The improved reliability is based on the fact that a substantially shorter fibrous unit can be used as compared to the present solutions. Thus the fibrous unit can be made stiffer, whereby it returns better into its longitudinal direction and the fibrous units also have a better guiding effect in the coating.

In the following description, the present invention is illustrated in detail with reference to the appended drawings. In the drawings,

DETAILED DESCRIPTION OF THE PREFERRED EMBODIMENT(S)

Figure 1:
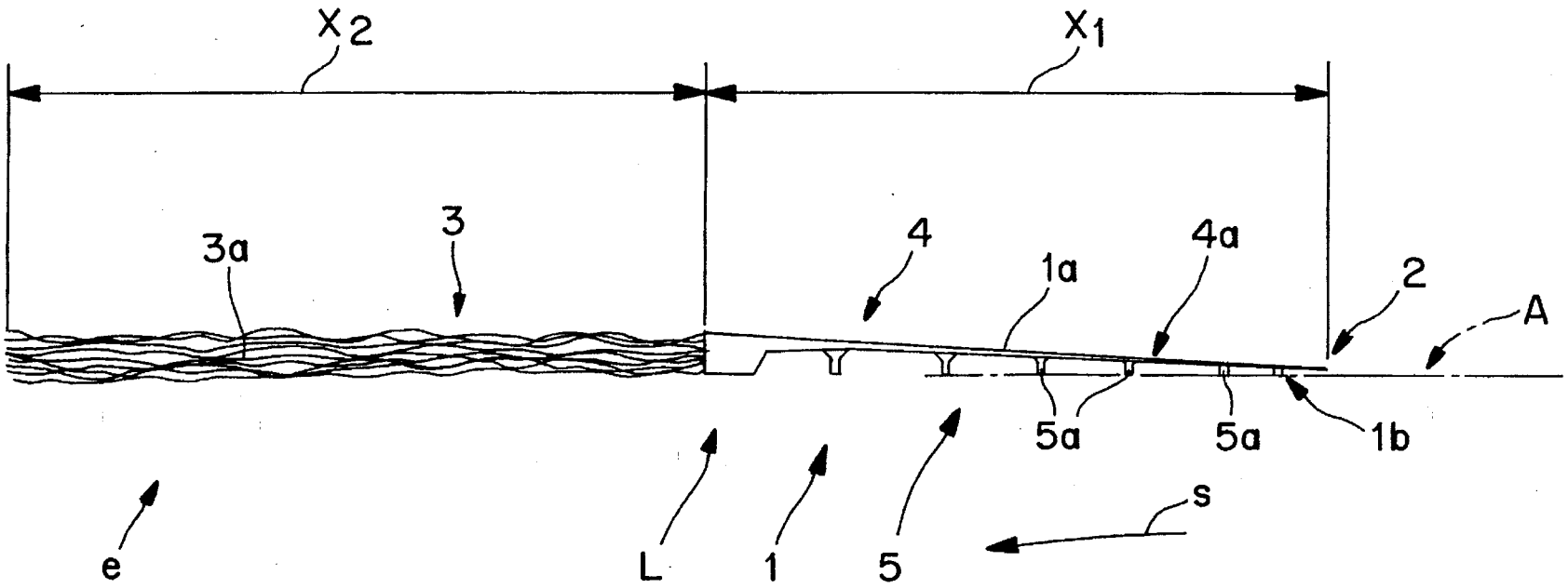
FIG. 1 shows an advantageous surface element of the invention.
Figure 2:
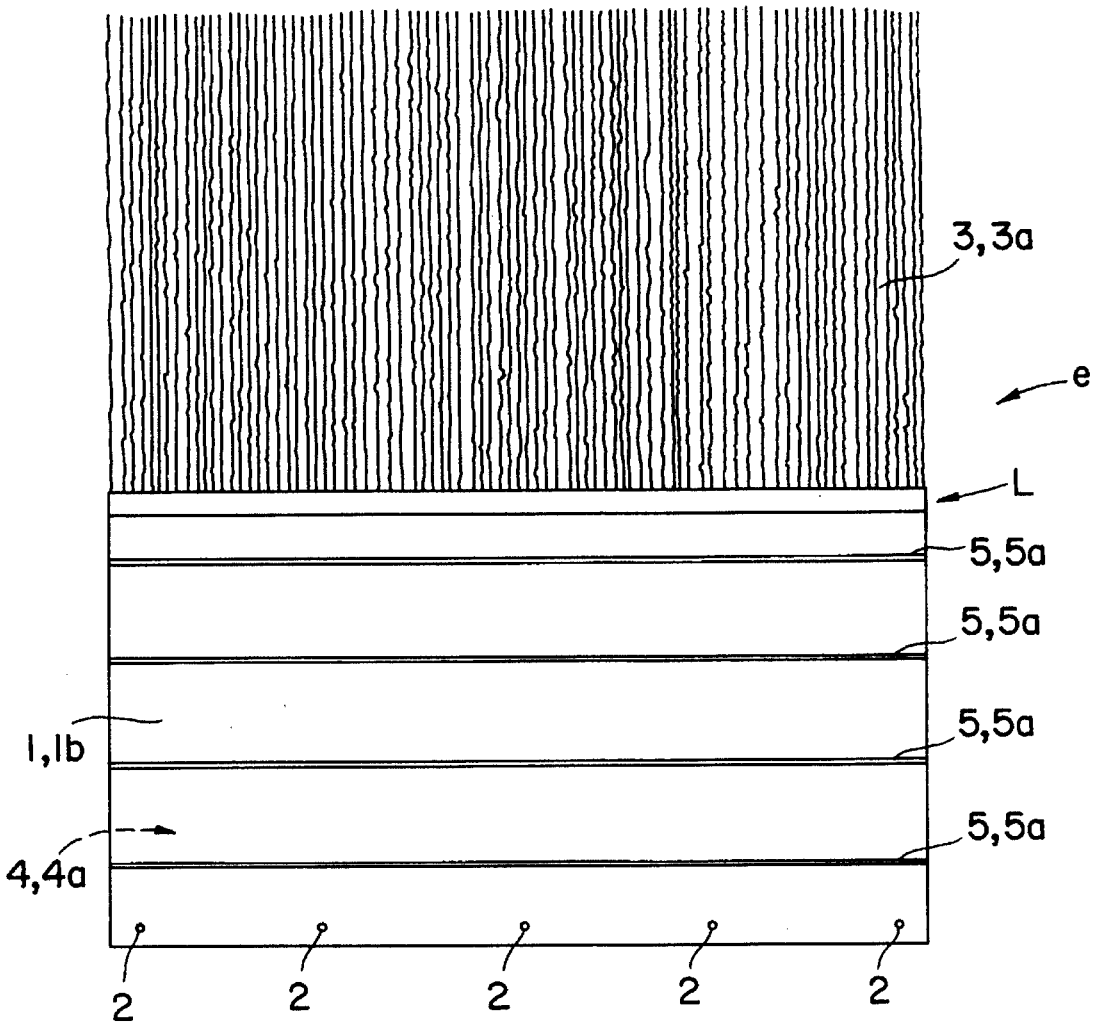
FIG. 2 shows a corresponding surface element as seen from below.
Figure 3:
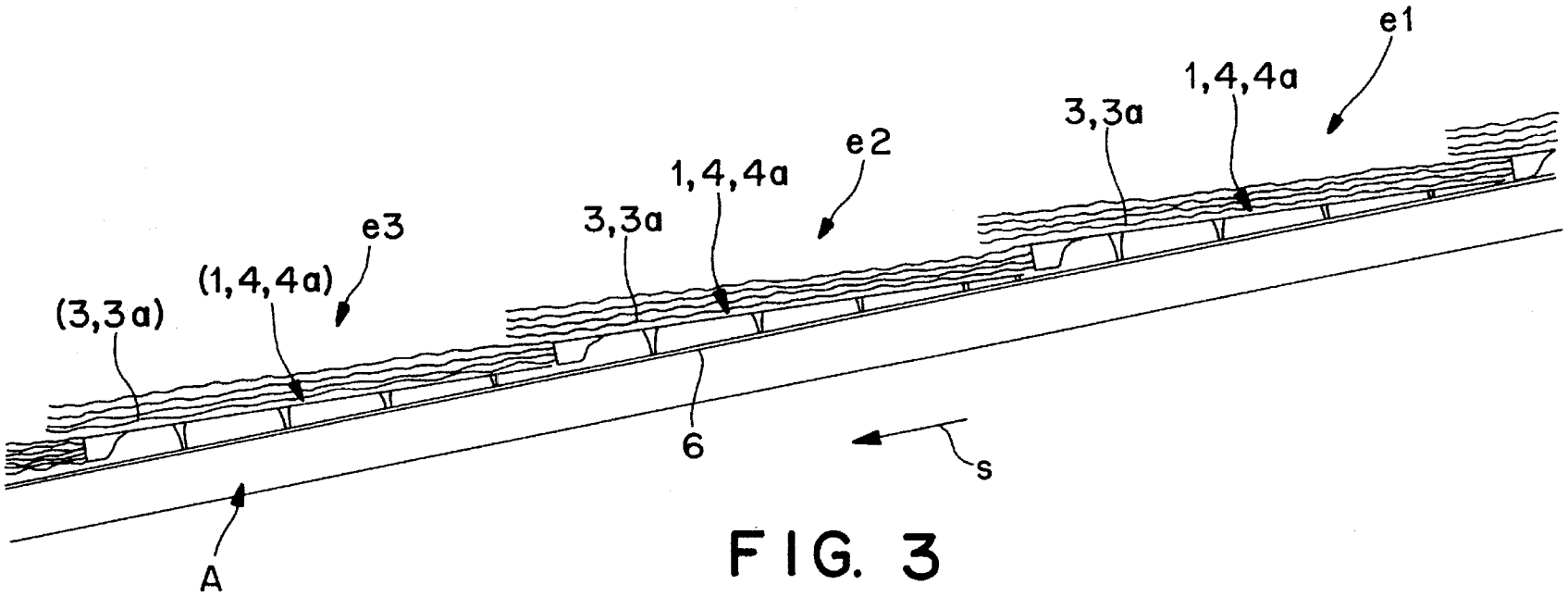
FIG. 3 shows the coating of a gliding surface formed of several surface elements.

The surface element shown as an advantageous embodiment in FIGS. 1–3 is intended for formation of a gliding surface, for example in a down-slope or the like. The surface element e comprises a substantially transverse frame unit 1, a gliding unit 3 and a supporting unit 4. The frame unit 1 is equipped with attaching means 2 for attaching the surface element e to a base A. The gliding unit 3 comprises several flexible gliding means 3*a* attached to the joining point L of the frame unit 1, such as fibres, strings, threads or the like. The supporting unit 4 comprises a supporting surface 4*a* connected with the frame unit 1 and continuously supporting the gliding unit 3 of at least one surface element e substantially in the longitudinal direction s. The supporting unit 4 of the surface element e is arranged in connection with the frame unit 1 in a way that in the surface structure formed of several successive surface elements e1, e2, e3 in the longitudinal direction s, the supporting unit 4 of the next surface element e2, e3 forms the supporting surface 4*a* supporting the gliding unit 3 of at least one preceding surface element e1, e2.

Further in an advantageous embodiment according to FIG. 2, the frame unit 1 of the surface element 1 extends in the longitudinal direction s in such a way that the holes 2 act as the attaching means, so that the surface element is attached for example with a binding to a framework 6 on the base A, are arranged at one end and the joining point L at the other end of the frame unit 1. Thus the supporting unit 4 is formed of the upper surface 4*a* of the frame unit 1. Further, the supporting surface 4*a* of the surface element is planar, thus enabling the return of fibres 3*a* to the longitudinal direction s as well as possible.

As shown in FIGS. 1 and 3, the height of the first end of the frame unit 1 of the surface element e is substantially lower than that of the other end, whereby the upper surface 4*a* of the frame unit 1 of the surface element is placed in an inclined position with respect to the base A. Thus, an advantageous gliding surface is achieved which is as continuous as possible in the longitudinal direction s.

In an advantageous embodiment, the part 1*a* of the frame unit 1 joining the joining point L is formed of a plate with an even thickness, equipped with placement means 5 for achieving the inclined position of the upper surface 4*a* of the frame unit 1. In the shown embodiment, the placement means 5 are formed by four protruding parts 5*a* with a width corresponding to that of the frame unit 1 and a small thickness in the longitudinal direction s in the middle part of the lower surface 1*b*. Further, in the height direction, the protruding parts 5*a* have a shape widening towards the lower surface 1*b* of the frame unit 1. By the constructions presented above, the use of the material for the frame unit 1, preferably polypropylene, is minimized and an advantageous flexible structure is achieved in the frame unit 1.

In a further advantageous embodiment, the length x1 of the frame unit 1 of the surface element e corresponds substantially to the length x2 of the gliding unit 3. Thus, a minimum material saving of 20% is obtained for the gliding unit. In addition, the length of the gliding unit can be arranged to be for example 50% shorter than in the present constructions, whereby the gliding unit can be made stiffer. Consequently, the gliding effect of the the gliding unit is emphasized, whereby it is also returned more securely to the longitudinal position.

It is obvious that the invention is not limited to the embodiment presented above but it can be modified within the basic idea even to a great extent. The supporting unit can be arranged in accordance with the principle described above also for example as a flexible plate separate from the frame unit, or as a plate attached to the frame unit in a flexible way. For security reasons it is thus essential that the supporting unit in connection with each surface element extends as an integrated surface substantially above the frame unit and the joining point included therein. It is obvious that the frame unit can also be arranged in principle as a separate plate or the like which is placed in the above-mentioned way partially above the frame unit of the surface element. In practice, however, a solution of this kind is not competitive with regard to manufacturing or installing techniques, because it requires that the frame unit and the supporting surface are manufactured separately, and separate attaching means must be arranged in both parts. The installation thus requires a double workload in comparison with the installation of for example an integrated surface element shown in FIG. 1. Most important, a solution of the type described above is not sufficiently secure either, because the supporting surface to be placed separately above the frame unit can, for reasons of manufacturing techniques or impurities, stones, and the like, conveyed between the frame unit and the supporting surface during operation, be loose at some sections of the frame unit supporting it, at which points the framework is thus almost directly exposed. This problem can be avoided by using the integrated frame element. In a corresponding manner, the frame unit can be formed to have an even thickness throughout, or to be integral and have a thickness being gradually reduced. The lower surface and/or the supporting unit of the frame unit can naturally be arranged to be corrugated in the longitudinal or transverse direction. The surface element of the invention can be manufactured of a large variety of materials by applying a variety of different manufacturing techniques.

I claim:

1. A surface element used for forming a gliding surface, said surface element including:

a frame unit provided with at least one attachment means and a joining point, said attachment means connecting said frame to a base;

a gliding unit formed of a plurality of flexible gliding means connected to said joining point of said frame unit, and a support unit forming a supporting surface and being connected to said frame unit, wherein when a plurality of successive surface elements are arranged in the longitudinal direction to form said gliding surface, the supporting unit of the next surface element supports the gliding unit of at least one preceding surface element.

2. A surface element according to claim 1, wherein the frame unit extends substantially in the longitudinal direction and has the attaching means arranged at one end and the joining point at the other end and wherein the supporting unit is formed of the upper surface of the frame unit.

3. A surface element according to claim 2, wherein the height of one end of the frame unit of the surface element is substantially lower than that of the other end, so that at least the upper surface of the frame unit of the surface element is placed in an inclined position with respect to the base.

4. A surface element according to claim 3, wherein at least a part of the frame unit at the joining point is formed of a plate having an even thickness, and is provided with placement means for achieving the inclined position of the upper surface of the frame unit.

5. A surface element according to claim 4, wherein the placement means are formed by at least one protruding part having a width corresponding to that of the frame unit and having a small thickness in the longitudinal direction, approximately in middle part of a lower surface of the frame unit.

6. A surface element according to claim 5, wherein at least one protruding part of the placement means has a shape widening towards the lower surface of the frame unit as seen in the height direction.

7. A surface element according to claim 1, wherein the supporting surface of the surface element is planar.

8. A surface element according to claim 1, wherein the length of the frame unit substantially corresponds to the length of the gliding unit.

9. A surface element according to claim 1 wherein the surface element is made of one of polypropylene, and polyethene.

10. An apparatus for formation of a gliding surface, comprising:

a plurality of surface elements extending successively in a longitudinal direction of the gliding surface, each surface element including:

a substantially transverse frame attached to a base;

a gliding unit formed of a plurality of flexible gliding elements, said gliding unit being connected to said frame at a joining point; and a supporting unit forming a supporting surface for supporting at least one gliding surface and connected with said frame, wherein said supporting unit of one surface element forms said supporting surface for supporting said gliding unit of at least one preceding surface element.

11. An apparatus according to claim 10, wherein said supporting unit is formed of an upper surface of said frame.

* * * * *